US010328399B2

(12) United States Patent
Lindström et al.

(10) Patent No.: US 10,328,399 B2
(45) Date of Patent: Jun. 25, 2019

(54) HIGH SPEED INJECTOR WITH TWO STAGE TURBULENCE FLAP

(71) Applicant: GL&V Luxembourg S.a.r.l., Munsbach (LU)

(72) Inventors: Anders Lindström, Forshaga (SE); Axel Lämås, Karlstad (SE)

(73) Assignee: KEMPULP AB, Stockholm (SE)

( * ) Notice: Subject to any disclaimer, the term of this patent is extended or adjusted under 35 U.S.C. 154(b) by 0 days.

(21) Appl. No.: 15/569,882

(22) PCT Filed: Apr. 27, 2016

(86) PCT No.: PCT/EP2016/059413

§ 371 (c)(1),
(2) Date: Jan. 29, 2018

(87) PCT Pub. No.: WO2016/174094

PCT Pub. Date: Nov. 3, 2016

(65) Prior Publication Data

US 2018/0117541 A1 May 3, 2018

(30) Foreign Application Priority Data

Apr. 29, 2015 (SE) ..... 1550522

(51) Int. Cl.

| | |
|---|---|
| ***B01F 3/04*** | (2006.01) |
| ***B01F 5/00*** | (2006.01) |
| ***B01F 5/04*** | (2006.01) |
| ***B01F 5/06*** | (2006.01) |
| ***D21C 9/10*** | (2006.01) |

(52) U.S. Cl.

CPC ..... *B01F 5/0473* (2013.01); *B01F 3/04* (2013.01); *B01F 3/04099* (2013.01); *B01F 3/04503* (2013.01); *B01F 5/00* (2013.01); *B01F 5/0471* (2013.01); *B01F 5/0611* (2013.01); *D21C 9/1005* (2013.01); *B01F 2005/0638* (2013.01); *B01F 2215/0078* (2013.01)

(58) Field of Classification Search

CPC ..... B01F 3/04; B01F 3/04099; B01F 5/00; B01F 15/04

USPC ..... 261/30, 76

See application file for complete search history.

(56) References Cited

U.S. PATENT DOCUMENTS

| | | | | |
|---|---|---|---|---|
| 3,198,479 | A * | 8/1965 | Greenwood | F16K 1/10 251/121 |
| 9,427,716 | B2 | 8/2016 | Jansson et al. | |
| 2014/0326323 | A1* | 11/2014 | Jansson | B01F 5/0471 137/8 |

FOREIGN PATENT DOCUMENTS

| | | | |
|---|---|---|---|
| WO | 2012/033461 | A1 | 3/2012 |
| WO | 2013/068049 | A1 | 5/2013 |

* cited by examiner

*Primary Examiner* — Robert A Hopkins

(74) *Attorney, Agent, or Firm* — James Earl Lowe, Jr.

(57) ABSTRACT

An apparatus comprising a chamber enclosing a flow path of a first fluid and having a second inlet arranged downstream of the first inlet for receiving a second fluid. The apparatus further comprises a vertically adjustable throttle body an end portion comprising three parts, the first part being upstream of the second part, the third part being downstream of the second part, wherein, in an operating position, the second inlet is upstream of the third part of the throttle body and downstream of the first inlet and wherein the first part and the third part of the end portion are adapted to achieve a higher flow rate than the second part.

11 Claims, 4 Drawing Sheets

HIGH SPEED INJECTOR WITH TWO STAGE TURBULENCE FLAP

TECHNICAL FIELD

The present invention relates to an apparatus and a method for mixing a first fluid with a second fluid, particularly for mixing steam into pulp.

BACKGROUND ART

As used herein, fluid means a gas, a liquid, a steam or a mixture of these. As used herein, the notion fluid is also mean to include a system consisting of a mixture of solid particles and a liquid or gas, where the mixture has fluid-like properties. One example of such a system is a suspension, e.g. a cellulose pulp suspension.

As used herein, introducing one fluid into the flow path of another fluid means injection, mixing, dispersion or other admixing of one fluid, which is also called the admixture fluid, into the flow path of the other fluid.

It is not unusual in industrial processes that fluids are mixed with each other. In e.g. the paper industry, it is not unusual that process chemicals, e.g. oxygen gas, chlorine dioxide or ozone, are introduced into a flow of pulp suspension. It is also common in this industry that steam is introduced into the flow of pulp suspension with the purpose of heating the pulp suspension.

There are a number of previously known methods and apparatuses for introducing one fluid into another fluid. One problem with these devices is that they are relatively energy intensive and that they require relatively much maintenance.

When introducing one fluid into the flow path of another fluid, it is generally always desirable to obtain a mixing or dispersion of the fluids which is as effective and uniform as possible.

One objective when injecting one fluid into another fluid, particularly when injecting steam into pulp suspension, is to admix i.e. to mix and disperse the added steam.

If the mixing or dispersion is not sufficient, there is a risk of steam bubbles forming in the liquid or suspension, wherein said steam bubbles may subsequently implode. These steam implosions cause pressure shocks in the liquid or suspension, which in their turn may propagate to machine supports, apparatuses and other process equipment and cause knocks and vibrations, which can be so powerful that mechanical damage results. This is especially a problem when a large amount of steam is added to a cellulose pulp suspension and especially to a cellulose pulp suspension of medium consistency. As used herein, a pulp suspension of medium consistency means a pulp suspension having a dry solids content in the range of approx. 8-14%.

Accordingly, there is a need to maximize and improve the mixing and dispersion of the fluids, in order to increase efficiency and minimize the risks of e.g. damaging equipment.

SUMMARY OF THE INVENTION

It is an object of the solution to address at least some of the problems outlined above. It is possible to achieve this object, and others, by using methods and apparatuses as defined in the attached claims.

According to a first aspect, an apparatus for mixing a second fluid into a first fluid is provided. The apparatus comprises a chamber enclosing a flow path of the first fluid, the chamber having a first inlet for receiving the first fluid and a second inlet arranged downstream of the first inlet for receiving the second fluid. It further comprises an outlet, arranged downstream of the second inlet, for discharging a mixture of said first fluid and said second fluid, wherein the flow path of the first fluid extends from the first inlet to the outlet and the second inlet opens into the flow path of the first fluid. The apparatus also comprises a vertically adjustable throttle body having a first end disposed at a bottom portion of the chamber and a second end comprising an end portion. The throttle body is arranged inside the chamber, downstream of the first inlet and upstream of the second inlet, for controlling the flow area of the flow path. The throttle body is adapted to be vertically adjustable in such a way that the flow area decreases with a decreasing flow rate of the first fluid and increases with an increasing flow rate of the first fluid. The end portion of the throttle body comprises three parts, the first part being upstream of the second part, the third part being downstream of the second part. In an operating position, the second inlet is upstream of the third part of the throttle body and downstream of the first inlet, with the first part and the third part of the end portion being adapted to achieve a higher flow velocity than the second part. By having a throttle body arranged as described herein, the mixture of the fluids is improved because of the end portion of the throttle body causing a higher turbulence. The end part of the throttle body is typically positioned downstream of the second inlet, i.e. downstream of where the second fluid is injected since it is aimed at improving the mixing of both fluids rather than increasing the turbulence in just one fluid.

There may be spring means disposed between a bottom side of the throttle body and the bottom portion of the chamber, the spring means being adapted to counteract the force exerted on the throttle body by the first fluid.

The end portion of the throttle body may be adapted such that the flow area at the first part and the third part is smaller than the flow area at the second part. This results in a velocity increase right before the injection point, as well as a velocity increase after the mixing of the first and the second fluids, which results in more turbulence and therefore better mixing of the fluids.

The first part and the third part of the end portion may be protrusions and the second part may be an indentation, resulting in the end portion of the throttle body being shaped as a substantially angular U or V. The form of the end portion of the throttle body is intended to accomplish the above-mentioned increase in velocity before and after the mixing of fluids.

The second inlet may comprise a valve adapted for controlling the velocity of the second fluid at a point where the first fluid and the second fluid are mixed. By having such a valve, it becomes possible to have a greater control of the velocity of the second fluid, which in turn facilitates the mixing of the fluids.

The apparatus may further comprise a baffle disposed downstream of the second inlet, the baffle being adapted to redirect the flow. By having such a baffle which redirects the flow, the turbulence increases and the mixing is improved.

The baffle may further be adapted to redirect the flow towards the outlet.

The second inlet may be arranged substantially perpendicular to the flow path of the first fluid. By having an angle between the flow path of the first fluid and the inlet of the second fluid that is substantially perpendicular, the turbulence increases and mixing is improved.

According to a second aspect, there is also provided a method for mixing a second fluid into a first fluid. The method comprises causing the first fluid to flow in a chamber from a first inlet to an outlet, the chamber enclosing the flow path. The method further comprises supplying the second fluid into the flow path of the first fluid via a second inlet of the chamber, the second inlet being arranged downstream of the first inlet and upstream of the outlet, and causing a vertically adjustable throttle body, having a first end connected to a bottom portion of the chamber and a second end comprising an end portion and being arranged in the flow path, to adjust its position to control the flow area of the flow path, in such a way that the flow area decreases with a decreasing flow rate of the first fluid and increases with an increasing flow rate of the first fluid. The end portion of the throttle body comprises three parts, the first part being upstream of the second part, the third part being downstream of the second part. In an operating position, the end portion is upstream of or aligned with the second inlet, and downstream of the first inlet, with the first and third parts of the end portion being adapted to achieve a higher flow velocity than the second part.

By implementing a solution as described herein, it is possible to improve existing technologies for mixing a second fluid into a first fluid, particularly wherein the first fluid is a pulp suspension and the second fluid is steam. By implementing the herein suggested solution, the turbulence of the fluids may be increased which in turn results in a better mixing of the fluids. This entails both a better end product due to improved mixing as well as less damage caused by steam bubbles.

The above apparatuses and methods may be configured and implemented according to different various optional embodiments. Further possible features and benefits of this solution will become apparent from the detailed description below.

BRIEF DESCRIPTION OF DRAWINGS

The solution will now be described in more detail, by way of example, with reference to the accompanying drawings, in which.

DESCRIPTION OF EMBODIMENTS

Figure 1:
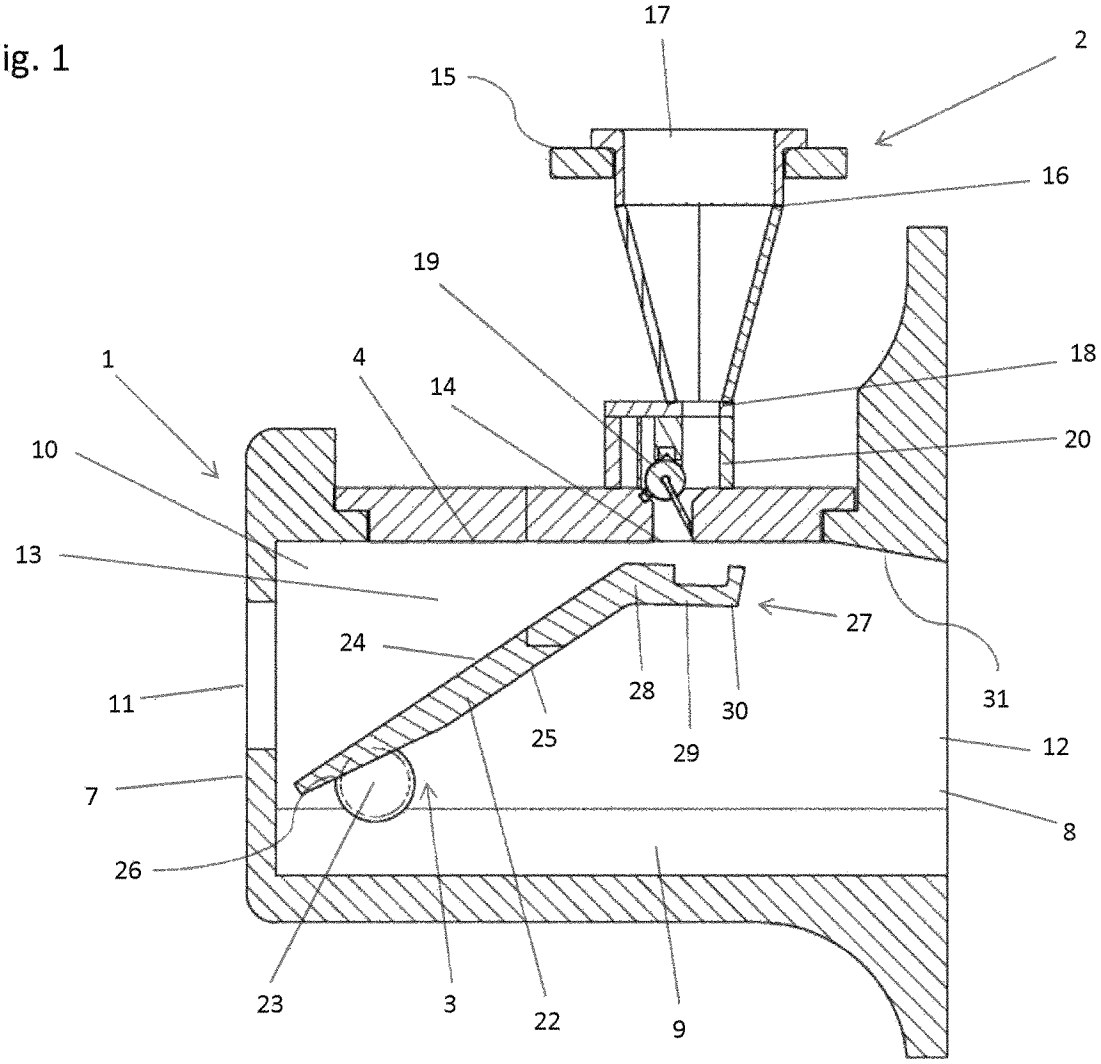
FIG. 1 shows a first embodiment of an apparatus according to the invention in a cross-sectional side view.
Figure 2:
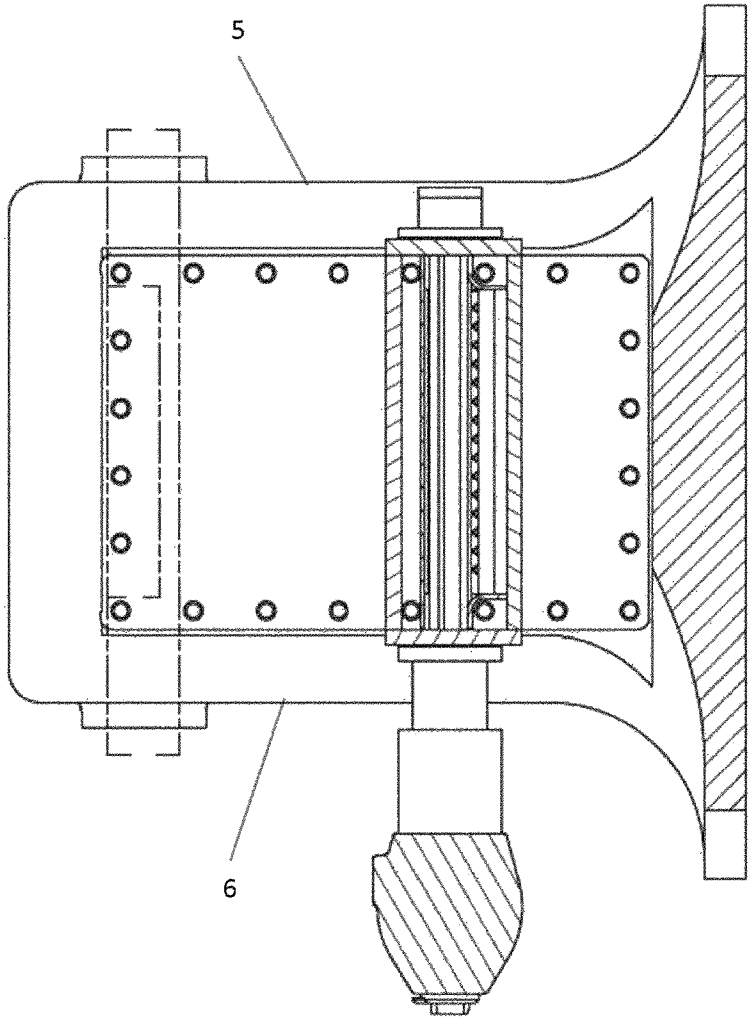
FIG. 2 shows the apparatus in in a top view.
Figure 3:
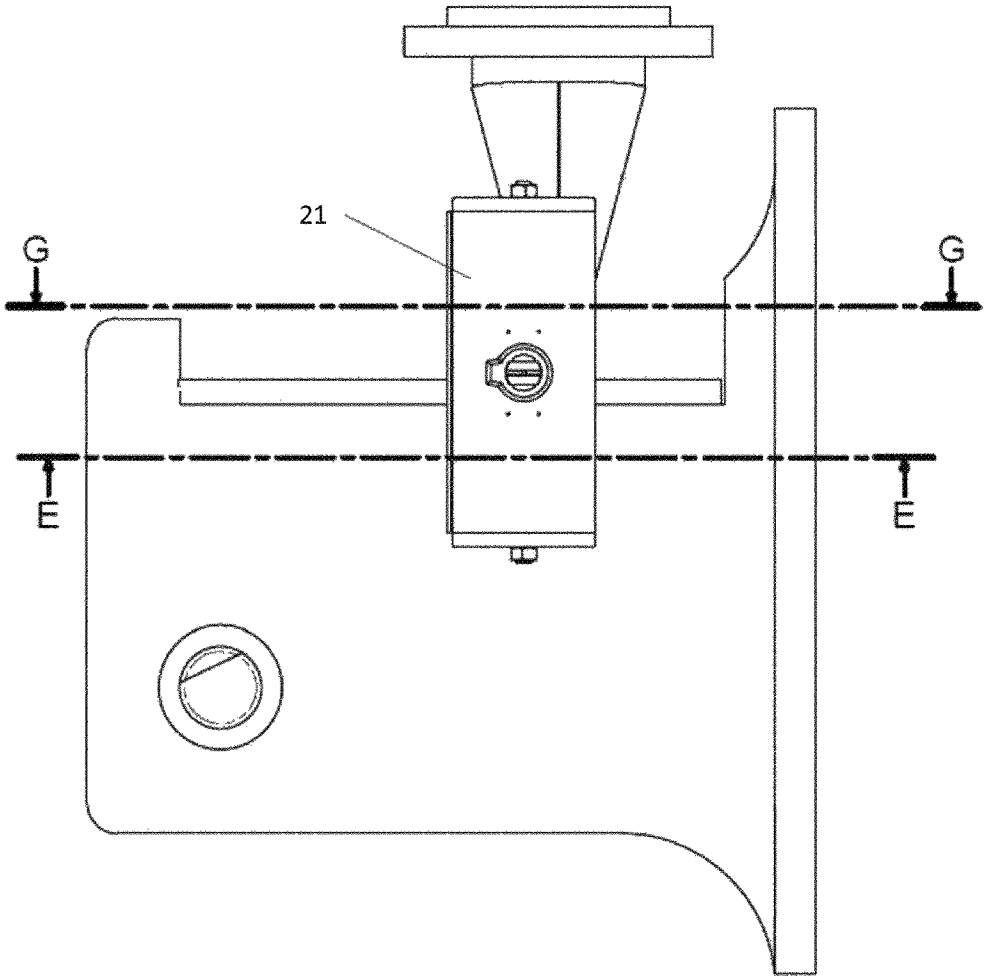
FIG. 3 shows the apparatus in a side view.
Figure 4:
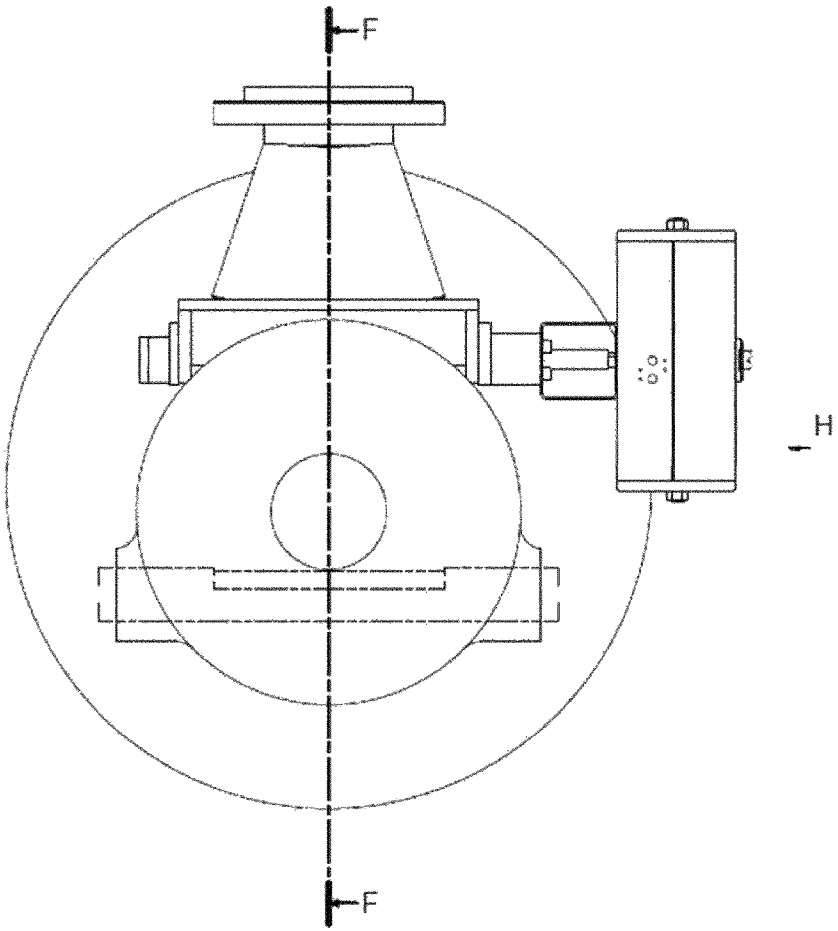
FIG. 4 shows the apparatus in a front view.

The embodiment of the invention that will be described in the following is intended to be used in a process plant for mixing a second fluid, in the form of steam, into the flow path of a first fluid, in the form of a cellulose pulp suspension, wherein the hot steam is intended for heating the pulp suspension to a desired temperature, e.g. to a temperature that is suitable for a subsequent bleaching step. It will be appreciated, however, that the principle of the invention may be used for mixing other fluids, such as gases, e.g. oxygen gas, chlorine gas or ozone, or liquids, e.g. pH-adjusting liquids, chlorine dioxide or other treatment liquid, into a pulp suspension. It will also be appreciated that the first fluid may be of another type than a pulp suspension, e.g. process liquor.

The apparatus comprises a substantially parallelepipedic housing 1, for receiving a pulp suspension from a first conduit, as well as for discharging the pulp suspension into a second conduit located downstream of the first conduit. The apparatus further comprises a supply means 2 for supplying steam to the flow of pulp suspension. The apparatus further comprises a control unit 3 with a main throttle body 22, which ensures that there is a suitable flow velocity in the pulp suspension when supplying the steam, in order to avoid the occurrence of steam implosions. Accordingly, the control unit 3, particularly the throttle body 22 ensures that the flow velocity of the pulp suspension exceeds a certain predetermined minimum value when supplying the steam.

The housing 1 is delimited externally by an upper delimiting surface, constituted by a roof portion 4, lateral delimiting surfaces, constituted by side walls 5 and 6 and by a short side wall 7 on a front side of the housing 1 and a short side wall 8 located on a back side of the housing 1, and a lower delimiting surface, constituted by a base portion 9.

Internally, the housing 1 comprises a substantially parallelepipedic chamber 10, which in some embodiments is approx. 500-700 mm long, approx. 200-250 mm wide, and approx. 150-300 mm high. The chamber 10 exhibits a circular first inlet 11 located in the side wall 7 for receiving the pulp suspension from the first conduit disposed upstream, and an outlet 12 located in the side wall 8 for discharging the pulp suspension into the second conduit disposed downstream. The first inlet 11 is formed by an opening in the short side wall 7 and in some embodiments has a diameter of approx. 80-200 mm. The inlet 11 has an area that is smaller than the cross-sectional area of the chamber 10. The outlet 12 is typically substantially the same size as the cross-sectional area of the chamber 10. Accordingly, the chamber 10 encloses a flow passage 13 for the pulp suspension, the flow passage 13 extending from the first inlet 11 to the outlet 12.

Furthermore, the chamber 10 exhibits an elongated second inlet 14 for receiving the pressurized, hot steam from the supply means 2, said inlet 14 opening into the flow passage 13. The inlet 14 is arranged in the roof portion 4 of the housing 1 and is located downstream of the first inlet 11 and upstream of the outlet 12. The supply means 2 connects to the second inlet 14 from the top side of the roof portion 4. The second inlet 14 is arranged with its longitudinal direction transversely to the chamber 10 and the flow passage, i.e. transversely to the flow direction of the pulp suspension, and extends across substantially the entire width of the flew passage 13. In other words, the second inlet 14 has a length that is substantially equal to the width of the chamber 10. The width of the inlet 14, i.e. its extension in the longitudinal direction of the chamber 10, is approx. 2-50 mm.

Removable stoppers may be arranged in the base portion 9 of the housing 1. The stoppers enable rinsing of the housing 1 in case of so-called plugging, i.e. that the pulp suspension clogs the housing 1.

The supply means 2, for supplying the pressurized, hot steam to the chamber 10 and the flow passage 13 via the second inlet 14, comprises a pipe flange 15 that may connect to a steam conduit for feeding pressurized steam to the supply means 2. Furthermore, the supply means 2 comprises a pipe part 16, which exhibits a first end 17 and a second end 18. The first end 17 connects to the pipe flange 15 and the second end 18 connects to a valve 19 of the supply means 2. The second end 18 is compressed, as is evident from FIG. 1, making the pipe opening of the second end 18 elongated. The valve 19 connects to the second inlet 14 of the chamber 10. In a typical embodiment the valve 19 is a rotatable valve, but in other embodiments it may also be for instance a knife gate valve.

The valve 19 may comprise a pivotal valve spindle and a valve spindle housing 20, enclosing the valve spindle. By turning the valve spindle, the valve 19 may be adjusted to a fully open position, to a fully closed position, or to a desired position therebetween. However, in some embodiments the means for adjusting the opening of the valve may for instance be a button or a lever. The position of the valve spindle is controlled by a control means 21, which is disposed on the valve spindle housing 20 at one end of the valve spindle.

The valve 19 is directly connected to the second inlet 14, in order to achieve as much control as possible over fluid that will be injected, specifically control over the amount of fluid. The valve 19 may also be used to control the pressure. By having the valve 19 in as dose proximity as possible to the inlet 14, a higher control of both the amount of fluid and the velocity of the fluid is achieved as compared to having a gap between the valve 19 and the inlet 14. Typically, it is desirable to achieve a high velocity of the second fluid as it is injected into the first fluid, for achieving higher turbulence and better mixing.

The control unit 3 typically comprises a throttle body 22 in the form of a flap or lip 22, and is vertically adjustable to adjust the area of the flow path. In some embodiments, the throttle body 22 is vertically adjustable by is by having a pivotal axle 23, and is movable by use of the pivotal axel 23. However, in some embodiments there is not needed a pivotal axle 23. The control unit 3, more specifically the throttle body 22, may instead be movable vertically by use of height adjusting means, with the purpose of altering the area of the flow path.

The flap 22 is arranged inside the chamber 10 and has the shape of a substantially rectangular plate, having a thickness of approx. 10-40 mm. The flap 22 exhibits a top side 24, facing away from the base portion 9 of the housing 1, a bottom side 25, facing toward the base portion 9 of the housing, two parallel long sides facing toward the side walls of the housing, a first end 26 or short side 26 and second end 27 or short side 27 located downstream of the first end 26.

The flap 22 has its first end 26 fixedly connected to the pivotal axle 23 and extends downstream in the flow direction of the pulp suspension. The second end 27 of the flap 22 is free. The flap 22 typically has a length that is approx. 240-450 mm, i.e. slightly longer than the height of the chamber 10 and slightly shorter than the length of the chamber 10, so that its free end 27, located downstream, is substantially aligned with the second inlet 14 in an operating position.

The free end 27 generally has the form of a substantially angularly shaped U or V, more specifically it comprises at least three parts where the first part 28 and the third part 30 extend further in a vertical direction than the second part 29. This may be thought of as the first 28 and third 30 parts being protrusions and the second part 29 being an indentation. The free end 27 is shaped in this way in order to achieve a high velocity, which in turns creates more turbulence, of the first fluid and the second fluid, in order to improve the mixing of the fluids. The free end 27 comprises three parts, the first part 28 being located upstream of the second part 29, the second part 29 being upstream of the third part 30. The distance from the roof portion 4 of the chamber to the first part 28, and the distance from the roof portion 4 of the chamber to the third part 30, are substantially the same, while the distance from the roof portion 4 to the second part 29 is greater than the distances from the roof portion to the first part 28 and third part 30.

The first part 28 of the free end 27 is positioned and shaped such that the flow area is smaller than the flow area directly upstream of the first part 28 of the free end 27. This provides for a first velocity increase of the fluid at the first part 28. The end portion of the throttle body 27 is positioned substantially aligned with or downstream of the second inlet 14, since the end portion of the throttle body is intended to improve the mixture of the fluids it has to be disposed downstream of the injection point of the second fluid.

In some embodiments, the second part 29 of the free end 27 is positioned substantially directly below the second inlet 14, while the first part 28 is located just upstream of the inlet 14, and the third part 30 is located just downstream of the second inlet 14. As mentioned, the distance from the second part 29 to the roof portion 4 is greater than the distances from the first part 28 and the third part 30 to the roof portion 4, which entails that the flow area is larger at the second part 29 of the free end 27 than at the first part 28 and the third part 30. The third part 30 is positioned substantially the same as the first part in a vertical direction, which means that the flow area at the third part 30 is smaller than at the second part. This achieves a second velocity increase of the fluids when they pass from the second part 29 to the third part 30. One of the most prevalent problems of current systems is that the mixing is not sufficient, and increasing the turbulence in the fluids improves the mixing.

The first part 28 and the third part 30 are adapted to achieve a higher flow velocity of the fluid as compared to the second part 29, as well as relative to the flow velocity directly upstream of the first part 28. Typically, the higher and lower flow velocities are achieved by decreasing and increasing the flow area, respectively. This may be done as described above, with the first and third parts having a shorter distance to the roof portion 4 than the second part 29, thus decreasing the flow area relative to the flow area at the second part 29, as well as upstream of the first part 28.

In a typical embodiment, the surfaces of first part 27, the second part 28 and the third part 30 are flat and, in an operating position, substantially aligned with the roof portion and bottom portion of the chamber. In other embodiments the surfaces may be angled in order to achieve a gradual increase and/or decrease in flowrate. The top side 34 of the throttle body 22 is typically angled relative to the roof portion 4 and bottom portion 9 of the chamber, with the throttle body 22 virtually forming an upwards slope for the flow of the first fluid.

The flap 23 is possible to vertically adjust, in some embodiments by pivoting it, between a lower end position, where the bottom side 25 of the flap abuts against the base portion 9 of the chamber 10, and an upper end position, where the free end 27 of the flap 22 abuts against the roof portion 4 of the chamber 10. The flap 22 has a width that is substantially equal to the width of the chamber 10. Accordingly, when using the apparatus, the pulp suspension is forced to pass over the top side 24 of the flap 22.

When the flap 22 is located between its end positions, the flap 22 forms a constriction in the flow passage 13, where the flow area of the flow passage 13 decreases continuously from the first end 26 of the flap 22 to the free end 27.

Immediately downstream of the flap 22, i.e., directly downstream of its free end 27, there may be arranged a baffle 31 for redirecting the flow in order to create more turbulence and thus further improve the mixing of the fluids. Typically, the baffle 31 redirects the flow of the two mixed fluids towards the center of the chamber 10, and the flow area increases downstream of the baffle 31. The flow area of the flow passage 13, downstream of the flap 22, increases to substantially its initial value, i.e. to the same value as directly upstream of the flap 22. The inlet 14 opens near the free end 27 of the flap 22, and the steam is typically supplied at or upstream of the free end 27, in order to maximize the mixing of the fluids. The flap 22 is preferably disposed downstream of where the second fluid is injected into the first fluid, in order to achieve a better mixing of the two fluids.

While the pulp suspension passes over the flap 22, in an embodiment with the throttle body 22 being pivotally arranged, the pulp suspension exerts a torque about the axle 23 on the flap 22, which tends to push the flap 22 down, i.e. to pivot the flap 22 clockwise about the axle 23. Accordingly, the top side 24 of the flap 22 constitutes a guiding or diverting surface, which diverts the direction of flow of the flow path 13, with which surface the pulp suspension interacts to produce said downward torque.

There may be arranged spring means which are positioned on a bottom side of the control unit 3 and/or at the bottom portion 9 directly below the control unit 3. The spring means are intended to act as a counteracting force to the force exerted by the flow of fluid. The spring means may for example be bellows cylinders, pressurized to a predetermined pressure. When the spring means are compressed, they exert a torque on the flap 22 and the axle 23, which strives to push the flap up, i.e. to pivot the flap 22 anti-clockwise about the axle 23.

At a constant flow rate of the pulp suspension, the flap 22 adjusts itself to an equilibrium position, where the torque that the flow of pulp suspension exerts on the flap 22 is balanced by the torque that the spring means exert on the flap 22 in the other direction. In other words, the spring means are adapted to continuously exert a torque on the flap 22, which balances the torque that the pulp suspension exerts on the flap 22 at every flow rate of the pulp suspension.

If the flow rate of the pulp suspension increases, the flap 22 is pushed down, so that the smallest flow area of the flow passage 13, i.e. its flow area at the end 27, increases. If the flow rate of the pulp suspension stabilizes at this new, higher level, the flap 22 adjusts itself to a new equilibrium position, where the flow area of the flow passage 13 at the end 27 is larger than in the previous equilibrium position. If the flow rate of the pulp suspension decreases, the flap 22 is pushed up by the spring means, so that the flow area of the flow passage 13 at the end 27 decreases. If the flow rate of the pulp suspension stabilizes at this new, lower level, the flap 22 thus adjusts itself to a new equilibrium position, where the flow area of the flow passage 13 at the end 27 is smaller than in the previous equilibrium position. Accordingly, an increasing flow rate of the pulp suspension causes the flow area of the flow passage at the end 27 to increase, and a decreasing flow rate causes the flow area to decrease.

It will be appreciated that this controlling of the flow area compensates for the decrease and increase, respectively, in the flow velocity of the pulp suspension that results from a decrease and an increase, respectively, of its flow rate. If e.g. the flow rate of the pulp suspension decreases, also the flow velocity of the pulp suspension in the region upstream of the flap 22 decreases, since the flow area in this region is unchanged. However, due to the decreasing pressure of the pulp suspension on the flap 22 in this situation, the flap is pivoted 22 upward and the flow area at the flap 22 decreases. This, in its turn, implies that the flow velocity of the pulp suspension at the end 27 increases and is maintained at substantially the same level as before the flow rate decrease. If the flow rate of the pulp suspension increases, an adjustment is effected in the other direction, i.e. due to the increasing pressure of the pulp suspension on the flap 22, the flap 22 is pushed down, the flow area above the flap 22 increases, and the flow velocity of the pulp suspension at the end 27 decreases and is thereby maintained at substantially the same level as before the flow rate increase. Accordingly, the flap 22 acts as a throttle body, which controls the flow area of the flow passage 13 while being actuated by the spring means, so that the flow velocity of the pulp suspension is maintained within a desired range. Accordingly, the control unit 3 ensures that a decrease of the flow rate of the pulp suspension does not lead to a situation, where the flow velocity of the pulp suspension at the steam supply position falls below a level where the mixing of the steam risks becoming so inadequate that there is a risk of damaging steam implosions occurring. This is due to the fact that decreasing flow velocity equals decreased turbulence in the fluids, which in turns results in a less effective mixing.

In addition to the fact that the spring means abut against the flap 22 with a pushing force, the spring means also dampen any pressure waves which may occur in the pulp suspension, e.g. when the pulp suspension passes over the flap 22, or if damaging steam implosions still occur. Accordingly, the spring means may also constitute damping means.

Accordingly, the flap 22 adjusts itself to an equilibrium position, where the flow of pulp suspension imposes a pushing force on the flap 22, which is balanced by the force from the spring means. Thus, the flap 22 is self-adjusting and its actual angle relative to the base portion 9 is dependent on the magnitude of the pulp flow. A predetermined flow velocity range may be set by adjusting the abutting force of the spring means against the flap 22, whereby the desired equilibrium position may be set. By increasing the abutting force of the spring means the axle 23 is rotated so that the flap 22 is pushed up to a new equilibrium position. This implies that the cross-sectional area above the flap decreases, which causes the flow velocity of the pulp suspension at the second inlet 14 to increase as long as the flow rate is kept substantially the same.

Accordingly, the apparatus is self-adjusting in that the control unit 3 ensures that the flow velocity of the pulp flow at the second inlet 14 is always within a certain predetermined range, which typically is sufficiently high to avoid, or at least reduce the occurrence of steam implosions. The control unit 3 also ensures that an increase of the flow rate of the pulp suspension does not lead to an undesirably high flow resistance across the apparatus.

It will be appreciated that the minimum allowable flow velocity of the pulp suspension at the steam supply position is dependent on a number of factors, e.g. the concentration of the pulp suspension, the steam flow rate, i.e. the amount of steam supplied, etc. As an example of a suitable flow velocity range when supplying steam to a pulp suspension, it may be mentioned that, when mixing steam at a flow rate of approx. 2-20 kg/s into a pulp suspension of medium consistency, the flow velocity of the pulp suspension at the free end 27 should be within the range of approx. 24-35 m/s, if the embodiment shown in the figures is used.

In the foregoing, the invention has been described based on a specific embodiment. It will be appreciated, however, that further embodiments and variants are possible within the scope of the following claims. With reference to the above-described embodiment, for example another type of spring means may be used when applicable, e.g. cylinders of piston rod-type. It will also be appreciated that another pushing means may be used, e.g. a piston rod cylinder, a spring-loaded cylinder, or a mechanical spring, e.g. a torsion spring.

It will also be appreciated that the throttle body may have a different design than the above-described flap 22, as long as the intended purpose is still fulfilled. The throttle body may e.g. be wedge-shaped.

The invention claimed is:

1. An apparatus for mixing a second fluid into a first fluid, the apparatus comprising: a chamber enclosing a flow path of the first fluid, the chamber having a first inlet for receiving the first fluid and a second inlet arranged downstream of the first inlet for receiving the second fluid, an outlet, arranged downstream of the second inlet, for discharging a mixture of said first fluid and said second fluid, wherein the flow path of the first fluid extends from the first inlet to the outlet and the second inlet opens into the flow path of the first fluid; a vertically adjustable throttle body having a first end disposed at a bottom portion of the chamber and a second end comprising an end portion; wherein the throttle body is arranged inside the chamber, downstream of the first inlet and upstream of the second inlet, for controlling the flow area of the flow path, wherein the throttle body is adapted to be vertically adjustable in such a way that the flow area of the flow passage decreases with a decreasing flow rate of the first fluid and increases with an increasing flow rate of the first fluid, the end portion of the throttle body comprising three parts, the first part being upstream of the second part, the third part being downstream of the second part; wherein, in an operating position, the second inlet is upstream of the third part of the throttle body and downstream of the first inlet; and wherein the first part and the third part of the end portion are adapted to achieve a higher flow rate than the second part.

2. The apparatus according to claim 1, wherein the throttle body is pivotally arranged, with the first end of the throttle both connected to a pivotally arranged axis.

3. The apparatus according to claim 1, wherein the end portion of the throttle body is adapted such that the flow area at the first part and the third part is smaller than the flow area at the second part.

4. The apparatus according to claim 1, wherein the first part and the third part of the end portion are protrusions and the second part is an indentation.

5. The apparatus according to claim 1, wherein the end portion of the throttle body is located at the second inlet.

6. The apparatus according to claim 1, wherein the second inlet comprises a valve adapted for controlling the velocity of the second fluid at a point where the first fluid and the second fluid are mixed.

7. The apparatus according to claim 1, further comprising a baffle disposed downstream of the second inlet, the baffle being adapted to redirect the flow of the fluids.

8. The apparatus according to claim 7, wherein the baffle is further adapted to redirect the flow of fluids towards the outlet.

9. Apparatus according to claim 1, wherein the second inlet is arranged substantially perpendicular to the flow path of the first fluid.

10. Apparatus according to claim 6, wherein the valve is disposed adjacently to the top part of the chamber.

11. A method for mixing a second fluid into a first fluid, the method comprising: causing the first fluid to flow in a chamber from a first inlet to an outlet, the chamber enclosing the flow path; supplying the second fluid into the flow path of the first fluid via a second inlet of the chamber, the second inlet being arranged downstream of the first inlet and upstream of the outlet; and causing a vertically adjustable arranged throttle body, having a first end disposed at a bottom part of the chamber and a second end comprising an end portion and being arranged in the flow path, downstream of the first inlet and upstream of the second inlet, to vertically adjust in order to control the flow area of the flow path, in such a way that the flow area decreases with a decreasing flow rate of the first fluid and increases with an increasing flow rate of the first fluid, the end portion of the throttle body comprising three parts, the first part being upstream of the second part, the third part being downstream of the second part; wherein, in an operating position, the second inlet is upstream of the third part of the throttle body and downstream of the first inlet; and wherein the first part and the third part of the end portion are adapted to achieve a higher flow rate than the second part.

* * * * *